US005169008A

United States Patent [19]

Loew et al.

[11] Patent Number: 5,169,008

[45] Date of Patent: Dec. 8, 1992

[54] ANGLED MOUNTING OF CARPET OR LIKE SAMPLES

[75] Inventors: Jonathon A. Loew, East Meadow, N.Y.; George Miriello, Greensboro, N.C.

[73] Assignee: Burlington Industries, Inc., Greensboro, N.C.

[21] Appl. No.: 589,655

[22] Filed: Sep. 28, 1990

[51] Int. Cl.[5] ..... A47F 7/16

[52] U.S. Cl. ..... 211/45; 211/41; 211/128

[58] Field of Search ..... 211/45, 41, 50, 44, 211/128; 24/169

[56] References Cited

U.S. PATENT DOCUMENTS

| | | | |
|---|---|---|---|
| D. 165,194 | 11/1951 | Schiffer | 211/50 X |
| 1,008,124 | 11/1911 | Dudley | 211/41 |
| 1,699,025 | 1/1929 | Schulz | 211/55 X |
| 2,008,215 | 7/1935 | Kennedy | 211/41 X |
| 2,271,346 | 1/1942 | Rosenberger | 211/45 X |
| 2,742,161 | 4/1956 | Nuttall | 211/50 X |
| 3,191,776 | 6/1965 | Tokash | 211/50 X |
| 3,208,598 | 9/1965 | Glassenberg | 211/50 |
| 3,661,269 | 5/1972 | Scherzer | 211/128 X |
| 4,714,165 | 12/1987 | Solomon | 211/50 X |
| 4,909,398 | 3/1990 | Santucci | 211/50 |

FOREIGN PATENT DOCUMENTS

| | | | |
|---|---|---|---|
| 0126440 | 10/1949 | Sweden | 211/128 |
| 2176694 | 1/1987 | United Kingdom | 211/50 |

*Primary Examiner*—Blair M. Johnson
*Attorney, Agent, or Firm*—Nixon & Vanderhye

[57] ABSTRACT

A method and device are provided for mounting carpet or other floating samples, which are quadrate in configuration and relatively planar and stiff. Each sample is mounted so that first and second side right angled edges intersect at the lowest point of the sample, forming a downwardly facing V. Each of the first and second side edges makes an angle of between about 30–60 degrees with respect to a vertical line, with the sample face outward, the angle preferably being 45 degrees. The diagonal of each sample slopes downwardly from left to right. The samples are preferably mounted in groups, the samples in each group having the same color and preferably also the same shade, with only the top edges and a portion of the face of the samples in each group aside from the outward sample, being visible. The groups are mounted in a number of rows and columns closely positioned with respect to each other so that all of the groups of samples, except those in the bottom row and the right side edge, are visible as squares with an apparently vertical diagonal. The samples are mounted by supporting them at their first and second edges, and so that the carpet face of each is in a vertical plane. A plurality of individual mounting devices are connected together by a frame, each individual mounting device comprising an integral piece of plastic having a planar surface with first and second intersecting right angle edges, and a number of overlapping open top channels at each of the intersecting edges.

35 Claims, 6 Drawing Sheets

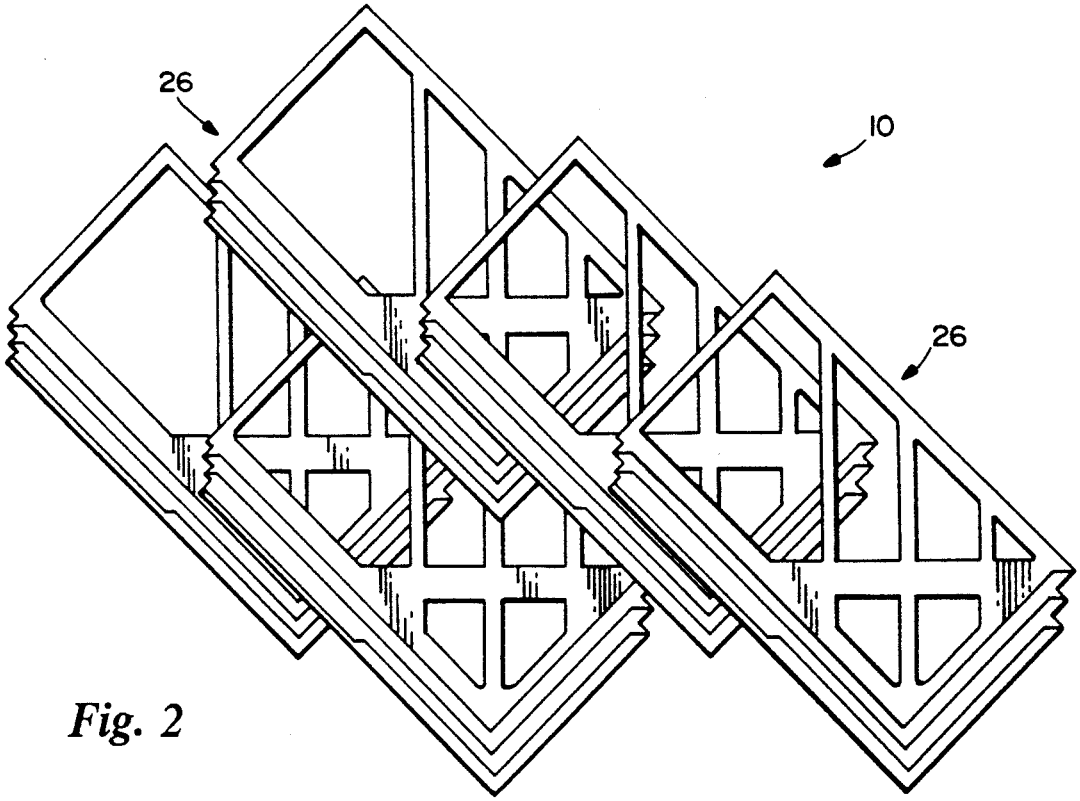
*Fig. 2*
*Fig. 5*
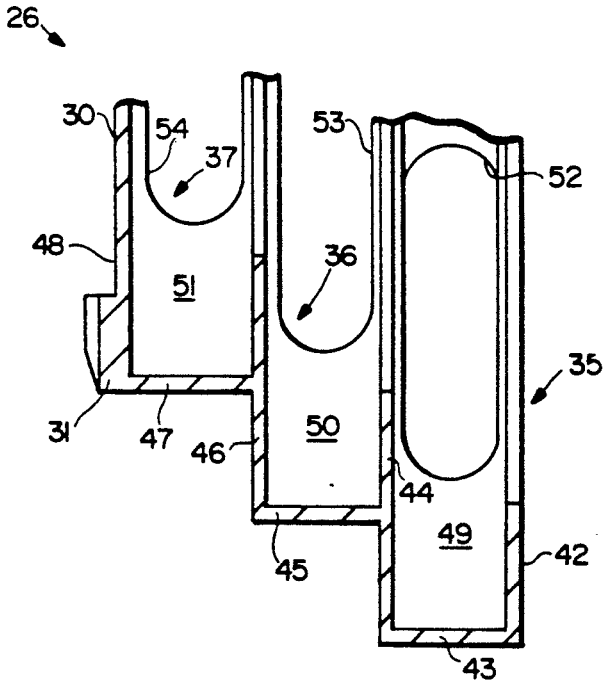

ANGLED MOUNTING OF CARPET OR LIKE SAMPLES

BACKGROUND AND SUMMARY OF THE INVENTION

A very important element in making a sale of carpeting, flooring, or other products that are too large to be individually displayed, is to aesthetically mount samples that are representative of the larger product, at the point of purchase. Not only must the samples be aesthetically displayed, but the samples must be clearly distinctive so that they are readily viewable without the potential purchaser having to move some samples to uncover others, and also they should be mounted in a nondestructive manner—so that the presence of some samples does not harm—even temporarily—other samples.

The achievement of all of the above described objectives has rarely, if ever, been achieved previously. However, according to the present invention all of the above objectives are achieved, and are achieved in a manner that many potential purchasers find extremely visually pleasing, readily catching the purchaser's eye and drawing the purchaser to the display. The invention comprises both a method and apparatus for displaying carpet samples, other flooring samples, or thin (planar) quadrate samples in general, at the point of purchase. The samples are mounted in such a way that each sample does not adversely impact upon the other samples in the display, so that all of the samples are highly visible, and so that the samples are arranged in a manner that does not require moving some samples to access others.

According to one aspect of the present invention, a method of mounting flooring samples that are quadrate in configuration, have a diagonal, and substantially right angled side edges including first and second side edges which intersect at the lowest point of each sample, and third and fourth side edges opposite the first and second side edges, and which intersect at the highest point of each displayed sample, and a flooring face, is provided. The method comprises the step of mounting the samples so that the first and second right angled side edges form a downwardly facing V, each of the first and second side edges making an angle of between 30 degrees and 60 degrees with respect to a vertical line extending through the right angle between the first and second side edges, with the flooring face outward; preferably each of the first and second side edges makes an angle of about 45 degrees with respect to the vertical.

Mounting is preferably accomplished by supporting each flooring sample at the first and second edges thereof, and so that the flooring face of each sample is in a substantially vertical plane. The samples are typically rectangular, and the mounting step is further practiced by mounting the samples in a plurality of rows and columns closely positioned with respect to each other so that all of the samples, except those in the bottom row and the endmost column, are visible as squares with an apparently substantially vertical diagonal. The samples are also preferably mounted in groups of more than one sample, samples in each group overlapping each other so that—except for the outwardmost sample in each group—only a portion of the third and fourth edges, an adjacent flooring face thereof are visible. Preferably three samples are mounted in each group, and where the samples are carpet samples, all the samples in each group are of the same color and preferably also of the same shade. The groups are also displayed so that preferably each sample is adjacent at least one other sample having the same color but a different shade.

A mounting device according to the invention comprises means defining a generally planar surface having first and second intersecting substantially right angle edges, and means defining a plurality of overlapping open top channels at each of the first and second intersecting edges for supporting generally planar elements in overlapping relationship, generally parallel to the planar surface. The planar surface may have a substantial void area so as to reduce cost, and the entire mounting device may be made of an integral piece of plastic. Preferably the planar surface is quadrate, and three open top channels are provided.

A plurality of mounting devices as described above are mounted by means for mounting the planar surfaces and associated open top channels so that first and second intersecting edges thereof form a downwardly facing V. The first and second channels preferably form a substantially 45 degree angle with respect to the vertical, and the mounting means include a plurality of generally triangular rod or tube assemblies, each having a front sloping element, and a plurality of vertically and horizontally extending attaching rods for attaching the planar surfaces to the front sloping elements.

It is the primary object of the present invention to provide for the aesthetic, nondestructive, and easily visible and accessible mounting of product samples that are substantially planar and relatively stiff, particularly carpeting and other flooring (e.g., wood or tile) samples. This and other objects of the invention will become clearly from an inspection of the detailed description of the invention and from the appended claims.

BRIEF DESCRIPTION OF THE DRAWINGS

FIG. 2 is a partial perspective view of the device of FIG. 1 with the carpet samples removed;

FIG. 5 is a cross-sectional view—taken along line 5—5 of FIG. 4—of the mounting channels of the elements of FIGS. 2 and 3;

DETAILED DESCRIPTION OF THE DRAWINGS

Figure 1:
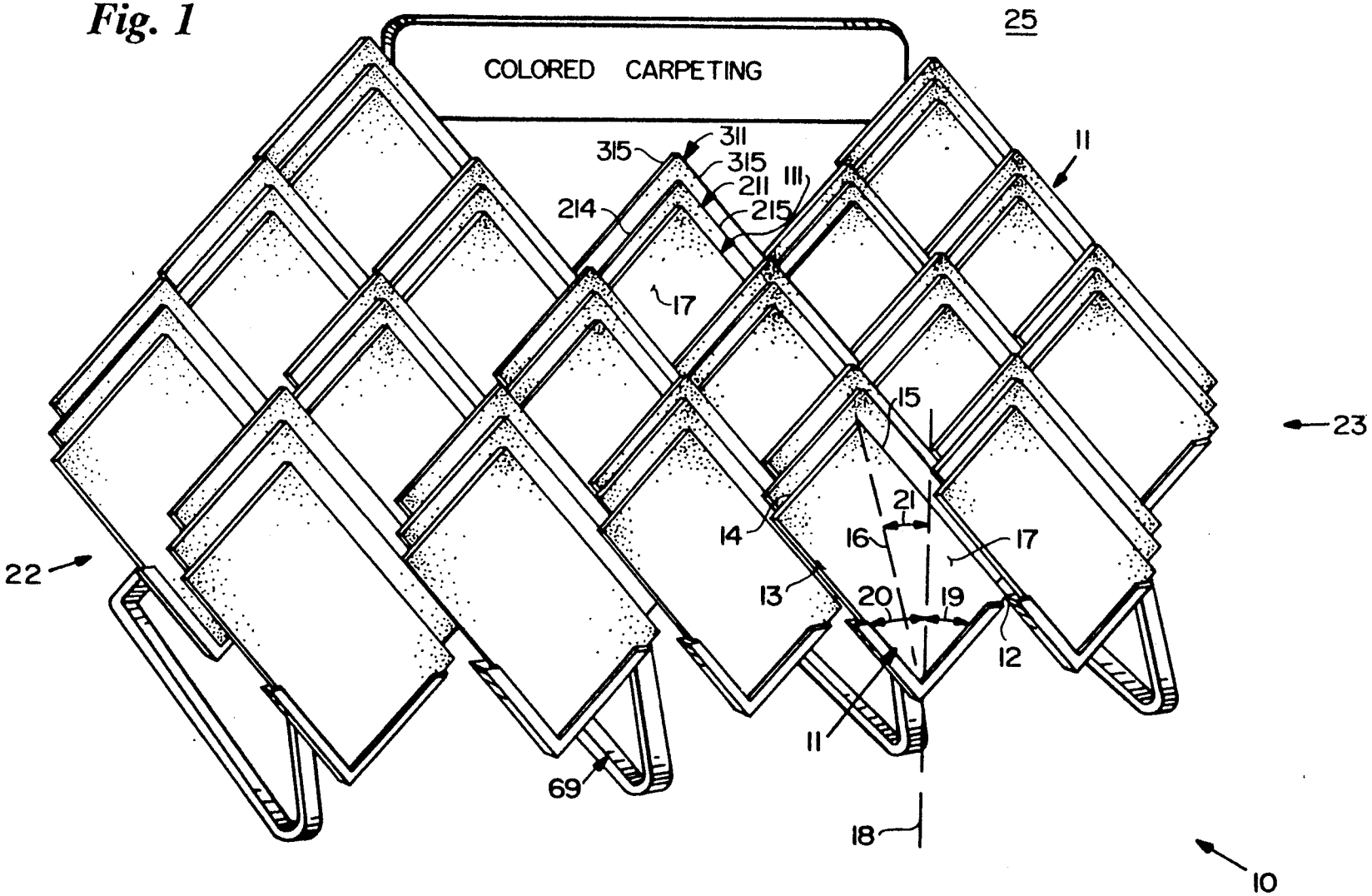
FIG. 1 is a top perspective view of an exemplary mounting device according to the present invention, for practicing the method of the present invention.

A display of flooring samples, or the like, according to the present invention is illustrated generally by reference numeral 10 in FIG. 1. Note that the display mounts a plurality of individual samples that are quadrate in configuration, and relatively planar (thin) and stiff, such as carpet samples, tile samples, wood floor samples, or other flooring samples or the like. An individual sample is shown generally by reference numeral 11 in FIG. 1, and has first 12 and second 13 side edges that, in use, intersect at substantially a right angle and form a downwardly facing V, and have third 14 and fourth 15 edges opposite the first 12 and second 13 edges, respectively, and intersecting at a substantially right angle to form a generally upwardly facing V, in use. A diagonal 16 is also provided between the angles formed by the first and second edges 12, 13 and the third and fourth edges 14, 15, respectively. The sample 11 also has a face—e.g. a carpet face—17, which faces outwardly. Typically the rear face of the sample 11 (opposite the carpet face 17, for example), is unattractive, whereas the face 17 has the qualities of the flooring or like product that are desirably displayed.

Figure 7:
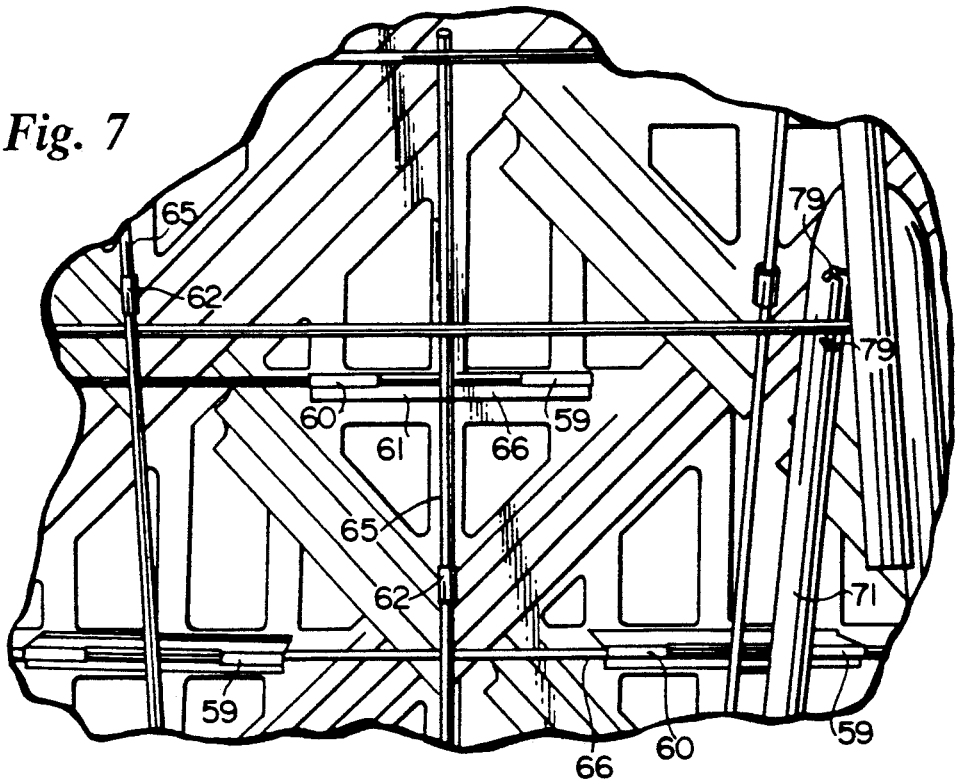
FIG. 7 is a rear perspective view of the display of FIG. 1.

As can be seen from an inspection of FIGS. 1 and 7 in particular, the mounting device 10 mounts the samples 11 so that the edges 12, 13 make an angle 19, 20, respectively, with respect to a vertical line 18 passing through the bottom of the downwardly facing "V". The angles 19, 20 are such that one angle 19, 20 is between about 30–60 degrees with respect to the vertical line 18, while the other angle is between 60–30 degrees. Preferably the angles 19., 20 are both about 45 degrees. The diagonal lines 16 also makes an angle 21 with respect to the vertical line 18 when the sample 11 is rectangular, the angle 21 being less than 30 degrees, and the diagonal 16 sloping downwardly from a first end 22 of the mounting device 10 to the second end 23 thereof. The entire display is normally most aesthetically pleasing when the diagonal 16 slopes downwardly from a left end 22 to right end 23.

As can also be seen from an inspection of FIGS. 1 and 7, the samples 11 are mounted in groups of more than one sample that have the same color (in the case of carpet samples), or same configuration (in the case of other flooring samples), and the same or a closely related shade. The samples 11 in each group overlap each other so that except for the outwardmost sample in each group, only a portion of the third and fourth edges and adjacent carpet face thereof are visible. For example, with respect to FIG. 1, an outermost top sample 111 is mounted in a group with two other samples 211, 311, a substantial portion of the carpet face 17 of the first sample 111 being readily visible, while for the other samples 211, 311 in the same group only the third and fourth edges 214, 215 and 314, 315—and a small border of the carpet face associated with the samples 211, 311—are visible. As also clearly seen in FIG. 1, particularly with respect to the samples 111, 211, 311, for all of the samples except for those in the bottom row and the column at the rightmost end, 23, all of the samples are visible as squares with an apparently substantially vertical diagonal. This arrangement is ultimately an enormously visually pleasing and aesthetic configuration, the rows and columns of samples having clean, readily distinguished, and overlapping edges, with individual samples 11, 111, etc., readily visible.

When displaying carpeting samples, for aesthetic reasons it also is preferably desirable to mount a majority of the samples so that they are adjacent other samples having the same basic color but a different shade. For example, the sample 111 may be a dark blue, while the sample immediately to the downward right thereof is of a medium blue, and the sample immediately to the downward right of the medium blue sample is a light blue sample. The sample immediately to the downward left may be white, while the sample in the same row to the left thereof may be a cream white.

A sign 25 preferably is provided mounted at the back of the device 10, which may indicate what is being displayed thereby (e.g., colored carpeting samples, the name of the manufacturer, availability, price, or any combination of the above).

The details of the mounting device are shown in FIG. 2–8. The device 10 comprises a plurality of basic mounting elements 26 which are mounted by a mounting means, shown generally by reference numeral 27 in FIG. 7, to provide the particular display of the samples 11 illustrated in FIG. 1.

Figure 3:
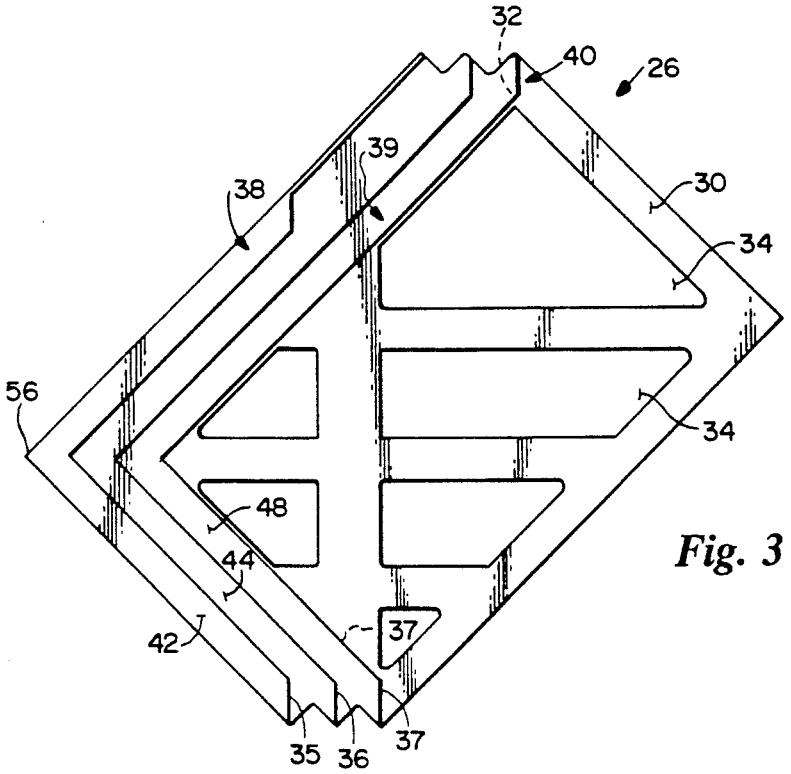
FIG. 3 is a top plan view of an individual mounting element of the device of FIGS. 1 and 2.
Figure 4:
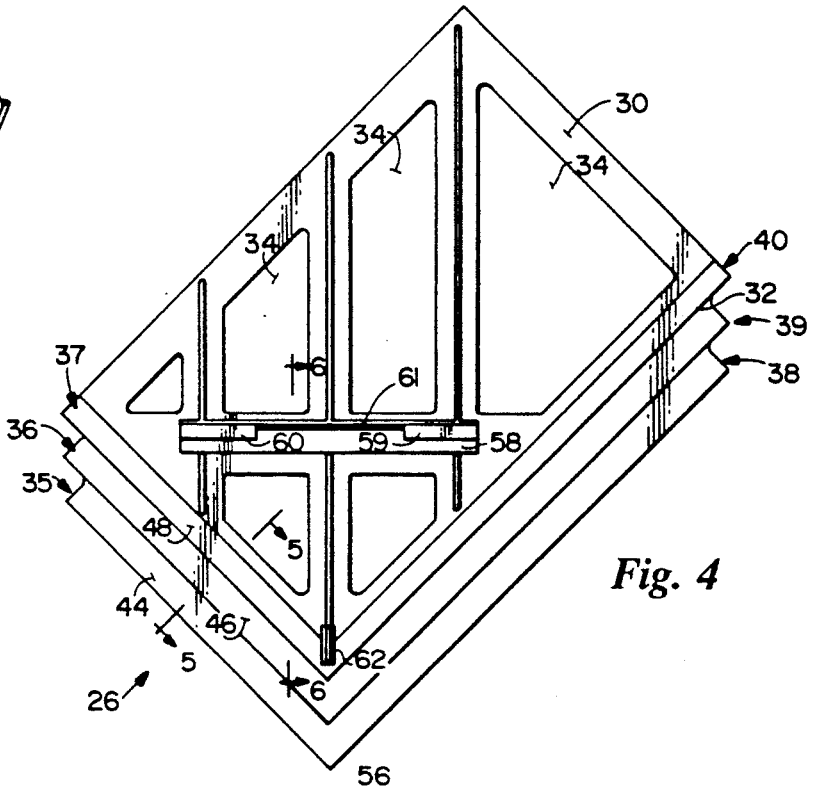
FIG. 4 is a bottom plan view of the element of FIG. 3.

The elements 26 per se are shown most clearly in FIGS. 3–5. Each element 26 comprises means defining a generally planar surface 30 having first and second side edges 31, 32 thereof, the edges 31, 32 intersecting at substantially a right angle, as indicated at the bottom left hand of FIG. 3. The planar surface 30 may be rectangular in configuration—as illustrated in FIGS. 3 and 4—although it need not necessarily be (for example, it could be triangular, or have an uneven circumference), depending upon the stiffness or other features of the planar samples to be held thereby. Also, in order to minimize material and weight, a substantial number of void areas 34 preferably are provided in the surface 30.

The element 26 also comprises means defining at least one, and preferably a plurality, of overlapping open top channels in each of the first and second intersecting edges 31, 32 thereof. For the specific embodiment illustrated in FIG. 3, which is particularly desirable, first 35, second 36, and third 37 open top channels are associated with the edge 31, while first, 38, second, 39, and third, 40, open top channels are associated with the second edge 32. Each of the channels has two side walls, and a bottom, with an open top. The channels 35 through 37 are seen most clearly in that regard in FIG. 5, the channel 35 having an outer side wall 42, a bottom wall 43, and an inner side wall 44 which comprises the outer side wall of the channel 36. The channel 36 also has a bottom 45, and an inner side wall 46 which also comprises the outer side wall of the channel 37. The channel 37 has a bottom 47, and an inner side wall 48. FIG. 5 also illustrates the bottom walls 49, 50, 51, respectively, of the channels 38, 39, 40. Note that the bottom walls 49–51 (as well as the walls 43, 45, 47, although not shown in the drawing) may have means defining cutouts or openings 52, 53, 54 therein, again to reduce the amount of material defining an element 26, and its weight. The cutouts 52, etc., are not necessary, however, and the walls could just as easily be solid.

While the elements 26 may be constructed of a wide variety of materials, and may be assembled together from components, preferably the elements 26 are of plastic and are formed integrally, including all of the channels 35–40 (e.g., by injection molding).

In use, the channels 35, 38 will support the first and second edges 12, 13 of the carpet samples 11, respectively, that is outwardmost sample (e.g., the sample 11 in FIG. 1), while the channels 36, 39 will support the corresponding first and second edges of the next sample 211, and the channels 37, 40 will support the corresponding first and second edges of the inwardmost sample 311.

On the back of the surface 30 (see FIG. 4 in particular) a number of surface manifestations are provided to facilitate mounting of the element 26 so that the edge 56 thereof will be the downwardmost facing portion of the element 26, and the channels 35, 38 will form a downward pointing V. The surface manifestations on the back of the surface 30—as seen in FIG. 4—include a flange 58 which has a pair of in-line tubular elements 59, 60 supported thereby, particularly from a flange portion 61 which extends generally perpendicular to the plane of the surface 30, and rearwardly thereof. There also is provided a tubular element 62 adjacent the corner intersections of the plurality of channels 35–40, an extension of the through extending passageway in the tubular element 62 intersecting the plane of the flange portion 61 at substantially a right angle.

Figure 8:
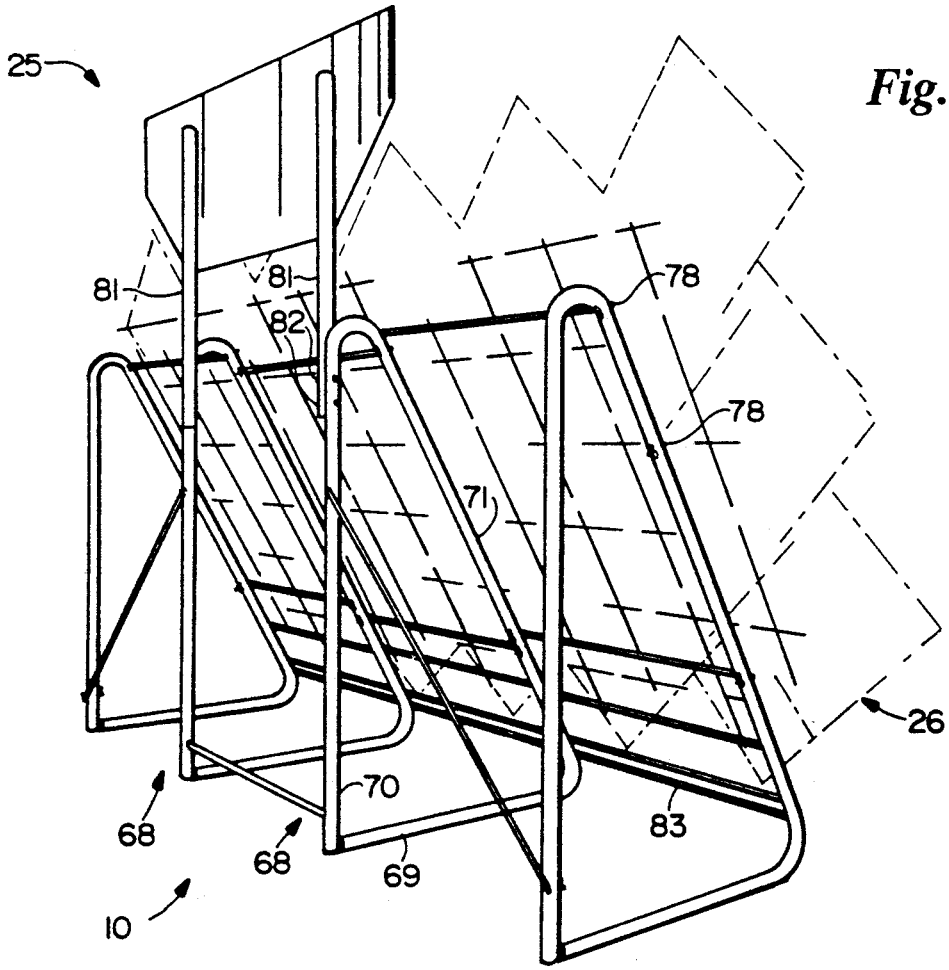
FIG. 8 is a rear view of the detailed mounting components of the display of FIG. 1.

The elements 26 are interconnected to each other—and to a final support—by a plurality of generally vertically and horizontally extending attaching rods which go through the tubes 62, and tubes 59, 60, respectively. FIG. 8 perhaps best illustrates this, showing a plurality of vertical rods (e.g. steel rods) 65 which pass through a plurality of the tubes 62 and have an interference fit therewith, and a plurality of generally horizontal rods 66 which pass through the tubes 59, 60, and have an interference fit therewith, a supporting grid work for the elements 26 thus being provided.

Mounting means for mounting the elements 26—in addition to the grid work of the attaching rods 65, 66—also comprises a plurality of floor engaging supports, such as the plurality of generally triangular rod or tube assemblies shown generally by reference 68 in FIG. 7. Each of the generally triangular rod or tube assemblies 68 includes a bottom, floor engaging element 69, which makes substantially a right angle with an upwardly extending rear element 70, and has a front sloping element 71 connected to the elements 69, 70 at the ends thereof. The elements 69 may be made of round tubing (as seen in FIG. 7), or square or other cross-section of tubing (as seen in FIG. 1).

Figure 6:
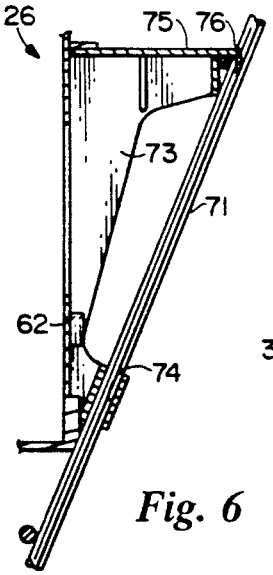
FIG. 6 is a side view, partly in cross section and partly in elevation, of a detail of one exemplary manner of mounting the individual elements of FIGS. 3 and 4, taken along line 6—6 of FIG. 4.

As seen in FIG. 6, the elements 26 may be connected to the elements 71 by providing—at predetermined locations—brackets 73 attached to the rear of the elements 26, and having a semicircular collar 74 for clipping onto an element 71, and a horizontally extending support 75 with cutouts 76 therein for engaging sides of an element 71. However, the structures 73 are not necessary, and alternatively—as illustrated in FIGS. 7 and 8—mounting is effected by metal mounting brackets 78 which are attached by adhesive, fasteners, or the like, to the rears of the elements (or some of the elements) 26 at predetermined locations therealong, and then in turn attached by bolts 79 (see FIG. 8) to an element 71. Note with this particular mounting—as illustrated in FIGS. 7 and 8—the vertical attaching rods 65 will engage the tops of the flange portion 61, and will have a tendency to mount the individual elements 26 so that the planar surface 30 thereof is substantially vertical (although it need not be completely vertical, i.e., it may tilt rearwardly or forwardly slightly).

As also illustrated in FIG. 7, the sign 25 may be mounted by supporting legs 81 and bolts 82 to the upstanding elements 70 of the two central triangular supports 68. Also, if necessary, to provide proper reinforcement, additional rods 83 may extend between the triangular supports 68 to properly support them in juxtaposition to each other.

Figure 9:
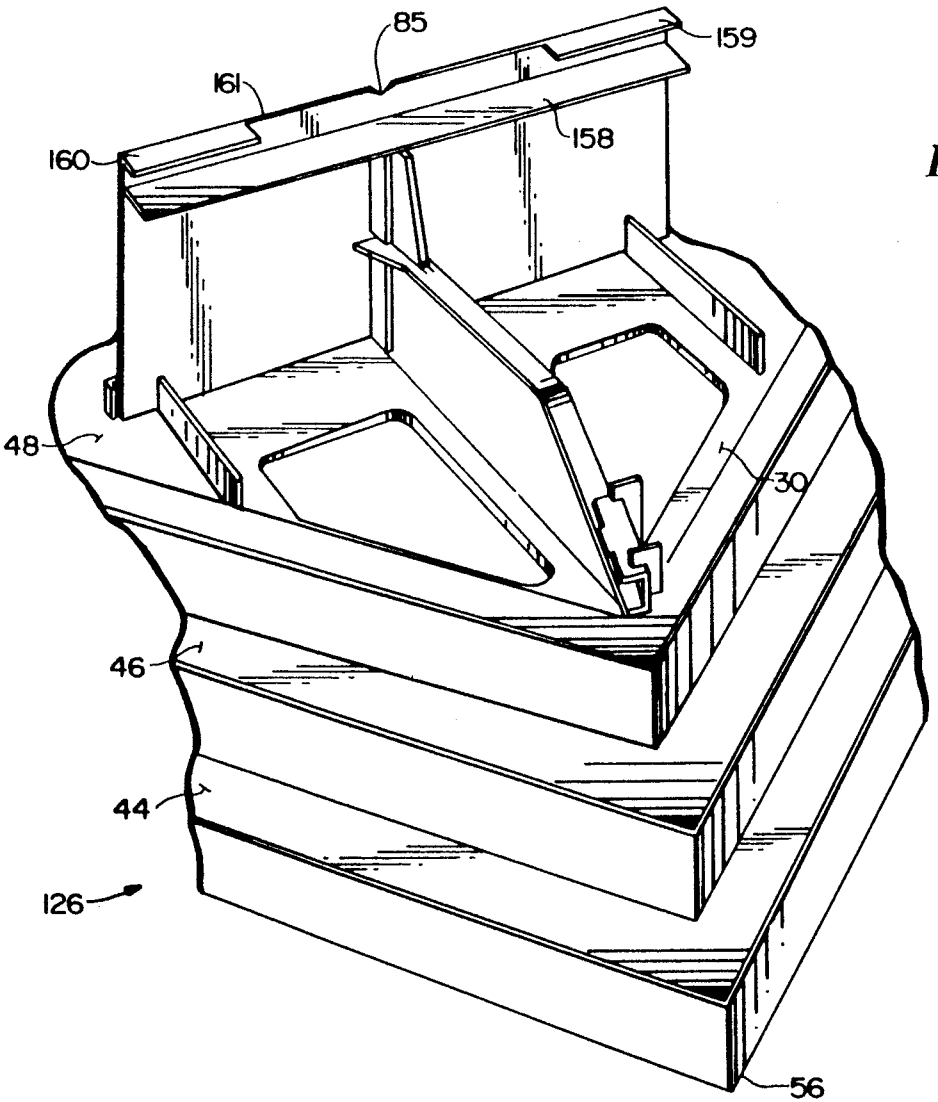
FIG. 9 is a rear, bottom perspective view of a minor modification of the device of FIG. 4 showing a slightly different mounting structure configuration for attachment to supporting rods.
Figure 10:
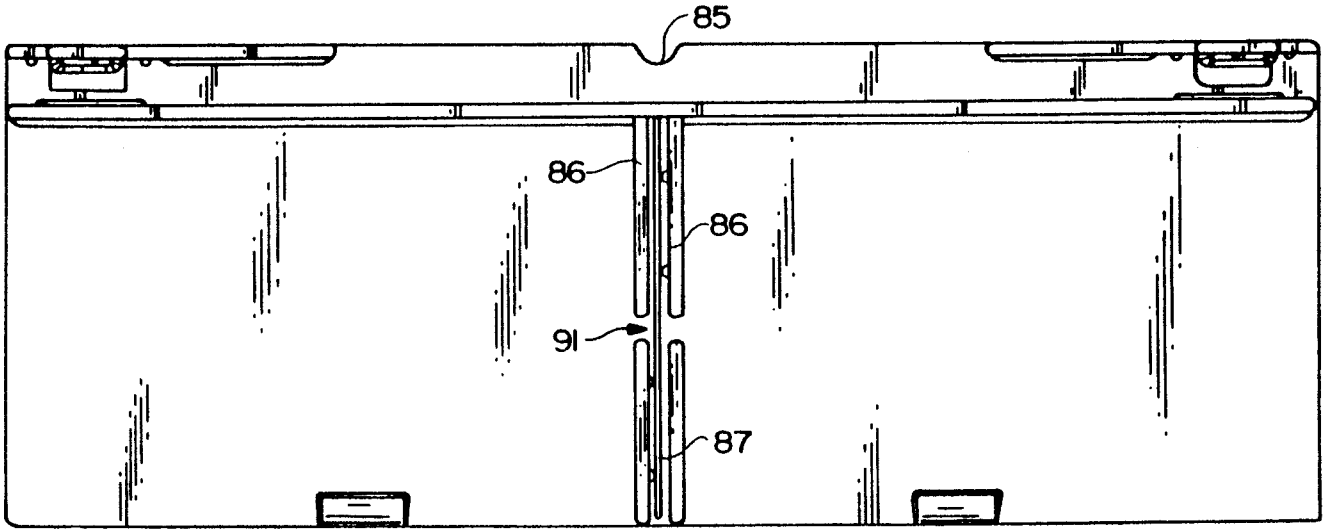
FIG. 10 is a plan view of one of the mounting structure elements of the FIG. 9 embodiment.
Figure 11:
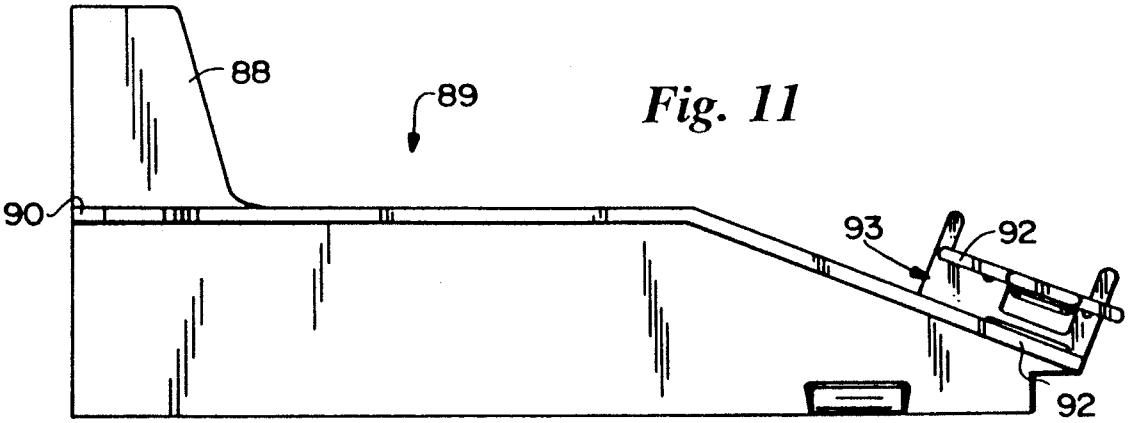
FIG. 11 is a plan view of the other of the mounting structure elements of the FIG. 9 embodiment.

A minor modification of the mounting structure for elements like elements 26 is shown in FIGS. 9–11. In this embodiment, structures having the same function and configuration as in the FIG. 4 embodiment are shown by the same reference numeral, and those having a comparable function and somewhat similar configuration are shown by the same reference numeral only preceded by a "1". This embodiment is identical to FIG. 3 as viewed from the front, and differs from that of FIG. 4 only in the specifics of the mounting structure.

As seen in FIGS. 9 and 10, the flange 158 of element 126 has a pair of in-line generally horizontal (in use) channel elements 159, 160 which extend generally perpendicular to the plane of the surface 30, and rearwardly thereof. Flange 158 has a rod-receiving depression 85 in the top edge 161 thereof. Generally vertical channel 87 is defined by walls 86 along a face of flange 158. The elements 159, 160 receive rods 66.

In order to positively support the flange 158 in its upright position, the edge 88 of support 89 (FIGS. 9 and 11) is received within generally vertical channel 87, between walls 86, and the perpendicular flange 90 of support 89 is received within cutout 91 in channel walls 86. The walls 92 (see FIG. 11) define a channel 93 which makes an angle with respect to the main face of flange 158, the channel 93 dimensioned to receive a rod 65 therein. It is easier to insert a rod 69 in the channel 93 than to thread it through the tubular element 62 of the FIG. 4 embodiment.

The entire structure in the FIG. 9 embodiment is preferably made up of five pieces of molded plastic, one piece forming the channels 35–37, another piece the channels 38–40, another planar surface 30, another flange 158, and the last support 89.

It will thus be seen that utilizing the mounting device 10, a method of mounting flooring samples that have right angle side edges (e.g., 12, 13) is provided, mounting the samples by supporting them at the first and second side edges 12, 13 so that those edges form a downwardly facing V, being received within the channels 35, 38 and so that the edges 12, 13 make an angle of about 30–60 degrees with the vertical 18 (preferably each make an angle of about 45 degrees), with the flooring face 17 outward. Also, the method preferably comprises providing samples in groups, and overlapping the samples—e.g., 111, 211, 311—in each group so that except for the outwardmost sample 111 the only portions of the other samples 211, 311 in each group of samples that are visible are portions of the third and fourth edges 214, 314, 215, 315 thereof, and portions of the display faces thereof adjacent the third and fourth edges.

It will thus be seen that according to the present invention a method and apparatus have been provided that effect aesthetically pleasing, enormously practical, mounting of carpet samples, or other flooring samples or like quadrate, generally planar (thin) and relatively stiff, samples. The samples are mounted in such a way that a significant portion of each is readily visible to the viewer, and the viewer can easily gain access to one sample without having to disturb the other samples. The user merely goes up to the device 10, and grabs and pulls upwardly on and removes the desired sample 11. It is easy to put the sample back in its proper place since one, two, or more remaining samples of the same general configuration (e.g., color and shade) are still provided at that location. Replacement is just as easy as removal, merely requiring placing of the edges 12, 13 in the open topped channels 35–40. Since the samples do not lay one on top of each other, there is no crushing or otherwise permanent or temporary damaging of one sample by its configuration or juxtaposition with respect to the other samples.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A method of displaying carpet samples which illustrate a carpet but are not intended to be used as a carpet themselves, and that are quadrate in configuration, have a diagonal, and substantially right angled side edges including first and second side edges which intersect at the lowest point of each sample, and third and fourth side edges opposite the first and second edges, and which intersect at the highest point of each sample, and a carpet face, comprising the step of:

mounting the carpet samples so that the first and second right angled side edges thereof form a downwardly facing V, each of said first and second side edges making an angle of about 45 degrees with respect to a vertical line extending through the right angle between the first and second side edges, with the carpet face outward; and wherein the samples are mounted in groups of more than one sample that have the same color and the same or a closely related shade, the samples in each group overlapping each other so that, except for the outwardmost sample in each group, only a portion of the third and fourth edges and adjacent carpet face thereof are visible.

2. A method as recited in claim 1 wherein the carpet samples are rectangular, and wherein said mounting step is practices so that the diagonal of each makes an angle of less than 30 degrees with respect to the vertical line, and slopes downwardly from a first end to a second end.

3. A method as recited in claim 2 wherein said mounting step is further practices so that the first end is the left end, and the second end is the right end.

4. A method as recited in claim 1 wherein one of the samples in each row and column is the first sample in that row or column, and wherein said mounting step is further practiced by mounting the groups of samples in a plurality of rows and columns closely positioned with respect to each other so that the first carpet sample in each of the groups of samples, except those in the bottom row and one end column, are visible as squares with an apparently substantially vertical diagonal.

5. A method as recited in claim 4 wherein the samples of each group have the same color and shade, and wherein said mounting step is further practiced so that the majority of carpet samples are adjacent other samples having the same color but a different shade.

6. A method as recited in claim 4 wherein said mounting step is further practiced by providing three samples in each group.

7. A method as recited in claim 1 wherein said mounting step is practiced by supporting each carpet sample at the first and second edges thereof.

8. A method as recited in claim 1 wherein said mounting step is practiced by supporting the samples so that the carpet face of each is in a substantially vertical plane.

9. A method as recited in claim 1 wherein said mounting step is practiced by supporting each carpet sample at the first and second edges thereof.

10. A method as recited in claim 1 wherein said mounting step is practiced by supporting the samples so that the carpet face of each is in a substantially vertical plane.

11. A method of mounting flooring samples which illustrate flooring but are not intended to be used as flooring themselves, and that are rectangular in configuration, have a diagonal, and substantially right angled side edges including first and second side edges which intersect at the lowest point of each sample, and third and fourth side edges opposite the first and second edges, and which intersect at the highest point of each sample, and a flooring face, comprising the step of:

mounting the flooring samples so that the first and second right angled side edges thereof form a downwardly facing V, each of said first and second side edges making an angle of between about 30 degrees and 60 degrees with respect to a vertical line extending through the right angle between the first and second side edges, with the flooring face outward, mounting the samples in a plurality of rows and columns closely positioned with respect to each other so that all of the flooring samples are visible.

12. A method as recited in claim 11 wherein said mounting step is practiced by supporting each flooring sample at the first and second edges thereof.

13. A method as recited in claim 11 wherein said mounting step is practiced by supporting the samples so that the flooring face of each is in a substantially vertical plane.

14. A method of mounting a plurality of groups of thin guadrate samples which are illustrative of a product but are not intended to be used as the product itself, each having a display face, a diagonal, and right angled side edges including first and second side edges which intersect at the lowest point of each sample, and third and fourth side edges opposite the first and second edges, and which intersect at the highest point of each sample, comprising the steps of:

mounting the samples so that the first and second side edges thereof form a generally downwardly facing V, and so that the display face of each sample faces outwardly and so that the groups are disposed in rows and columns; and overlapping the samples of each group so that except for the outwardmost sample the only portions of the other samples in each group of samples that are visible are portions of the third and fourth edges thereof, and portions of the display face adjacent the third and fourth edges thereof.

15. A method as recited in claim 14 wherein said steps are practiced so that three samples are provided in each group.

16. A method as recited in claim 14 wherein said mounting step is practiced by supporting each sample at the first and second edges thereof.

17. A method of mounting flooring samples which illustrate flooring but are not intended to be used as flooring themselves, and that have right angled side edges including first and second side edges which intersect at the lowest point of each sample, and a flooring face, comprising the step of:

mounting the flooring samples by supporting them at the first and second side edges so that the first and second edges thereof form a downwardly facing V, each of said first and second side edges making an angle of between about 30 degrees and 60 degrees with respect to a vertical line extending through the right angle between the first and second side edges, with the flooring face outward, and so that the flooring samples are disposed in a plurality of rows and columns.

18. A method as recited in claim 17 wherein said mounting step is further practiced by mounting said samples so that the first and second side edges thereof each make an angle of about 45 degrees with respect to the vertical line.

19. A device for displaying substantially planar sample elements which have substantially right angled intersecting first and second edges, comprising:

a plurality of individual means each defining a generally planar surface having first and second intersecting substantially right angle edges; and means defining a plurality of overlapping open top channels at each of said first and second intersecting edges for supporting substantially planar sample elements in overlapping relationship, generally parallel to said planar surface;

a plurality of rows and columns of said plurality of individual means; and means for mounting said plurality of rows and columns of said planar surfaces and associated open top channels so that said first and second intersecting edges form a downwardly facing V, the channels opening upwardly.

20. A device as recited in claim 19 wherein said mounting means further comprises means for mounting said planar surfaces so that they are in substantially vertical plane.

21. A device as recited in claim 20 wherein said mounting means further comprise means for mounting said planar surfaces and associated channels so that said first and second intersecting edges each form a substantially 45 degree angle with respect to the vertical.

22. A device as recited in claim 19 wherein said mounting means comprise a plurality of strut or tube assemblies, said assemblies each having a generally triangular configuration, and each including a front sloping element; and means for attaching said planar surfaces to said front sloping elements.

23. A device as recited in claim 22 wherein said means for attaching said planar surfaces to said front sloping elements comprise a plurality of generally vertically and horizontally extending attaching rods.

24. A device as recited in claim 23 wherein said means for attaching further comprise a plurality of brackets holding horizontally extending rods to said front sloping elements.

25. A device as recited in claim 19 wherein each said means for defining a planar surface and a plurality of channels comprise three pieces of plastic connected together.

26. A device for displaying substantially planar elements which have substantially right angled intersecting first and second edges, comprising:

a plurality of means defining a generally planar surface having first and second intersecting substantially right angle edges; and means defining a plurality of open top channels at each of said first and second intersecting edges for supporting substantially planar elements in overlapping relationship, generally parallel to said planar surface; and means for mounting said planar surfaces and associated open top channels so that said first and second intersecting edges form a downwardly facing V, the channels opening upwardly, comprising a plurality of rod or tube assembles, said assemblies each having a generally triangular configuration and each including a front sloping element; and means for attaching said planar surfaces to said front sloping element.

27. A device as recited in claim 26 wherein said mounting means further comprises means for mounting said planar surfaces so that they are in substantially vertical planes, and each of the side edges makes an angle of about 45 degrees to the vertical.

28. A device as recited in claim 26 wherein said means for attaching said planar surfaces to said front sloping elements comprise a plurality of generally vertically and horizontally extending attaching rods.

29. A method of displaying carpet samples that are quadrate in configuration, have a diagonal, and substantially right angled side edges including first and second side edges which intersect at the lowest point of each sample, and third and fourth side edges opposite the first and second edges, and which intersect at the highest point of each sample, and a carpet face, comprising the step of:

mounting the carpet samples so that the first and second right angled side edges thereof form a downwardly facing V, each of said first and second side edges making an angle of between about 30 degrees and 60 degrees with respect to a vertical line extending through the right angle between the first and second side edges, with the carpet face outward, and mounting the samples in a plurality of rows and columns closely positioned with respect to each other so that many of the carpet samples are visible as squares with an apparently substantially vertical diagonal.

30. A device as recited in claim 23 wherein said individual means are of plastic, and wherein said means for attaching said planar surfaces to said front sloping elements comprise integral structures associated with said plastic individual means and dimensioned and shaped to receive said rods therein.

31. A device as recited in claim 30 wherein said rod or tube assemblies of generally triangular configuration are of metal.

32. A device as recited in claim 28 wherein said individual means are of plastic, and wherein said means for attaching said planar surfaces to said front sloping elements comprise integral structures associated with said plastic individual means and dimensioned and shaped to receive said rods therein.

33. A device as recited in claim 32 wherein said rod or tube assemblies of generally triangular configuration are of metal.

34. A method of displaying carpet samples which illustrate a carpet but are not intended to be used as a carpet themselves, and that are quadrate in configuration, have a diagonal, and substantially right angled side edges including first and second side edges which intersect at the lowest point of each sample, and third and fourth side edges opposite the first and second edges, and which intersect at the highest point of each sample, and a carpet face, comprising the steps of:

mounting the carpet samples so that the first and second right angled side edges thereof form a downwardly facing V, each of said first and second side edges making an angle of between about 30 degrees and 60 degrees with respect to a vertical line extending through the right angle between the first and second side edges, with the carpet face outward; and mounting the samples in a plurality of rows and columns closely positioned with respect to each other so that many of the samples are visible as squares with an apparently substantially vertical diagonal.

35. A method as recited in claim 34 wherein said mounting step is further practiced so that the majority of carpet samples are adjacent other samples having the same basic color but a different shade.

* * * * *